United States Patent [19]

Halperin et al.

[11] 4,071,116

[45] Jan. 31, 1978

[54] LOAD CANCELLING DEVICE FOR CONVEYANCE SYSTEMS

[75] Inventors: Levi Ytzhak Halperin; Dov Zioni; David Bennet, all of Jerusalem, Israel

[73] Assignee: Shaare Zedek Hospital, Jerusalem, Israel

[21] Appl. No.: 629,365

[22] Filed: Nov. 6, 1975

[30] Foreign Application Priority Data

Nov. 12, 1974 Israel ..... 46035

[51] Int. Cl.[2] ..... B66B 1/32

[52] U.S. Cl. ..... 187/29 R

[58] Field of Search ..... 187/29

[56] References Cited

U.S. PATENT DOCUMENTS

| | | | |
|---|---|---|---|
| 2,669,324 | 2/1954 | Lund | 187/29 |
| 3,536,163 | 10/1970 | Iordanidis | 187/29 |
| 3,543,113 | 11/1970 | Miller | 187/29 UX |
| 3,543,883 | 12/1970 | Kuzara | 187/29 |

*Primary Examiner*—Robert K. Schaefer
*Assistant Examiner*—W. E. Duncanson, Jr.
*Attorney, Agent, or Firm*—Anthony J. Casella

[57] ABSTRACT

A load-cancelling system for conveyance systems, such as elevators, is especially adapted for cancelling the effect of the load weight on power requirements and includes at least one weighing device adapted to determine the weight of the load in the elevator. The system also includes a brake adapted to dissipate energy from the conveyance system and interface means between the weighing device and the brake for translating the result of the weighing operation to a corresponding braking operation.

10 Claims, 4 Drawing Figures

LOAD CANCELLING DEVICE FOR CONVEYANCE SYSTEMS

The present invention relates, in general, to a conveyance system in which the power requirement of its driving unit is independent of its load.

The term conveyance system used herein is meant to include all types of transport systems for human-beings, animals and articles or materials such as conveyors, escalators, elevators, trains, vehicles and the like.

More particularly, this invention is concerned with the cancellation of the effect of the load on the motor of such a system during its operation.

Considering for example the operation of a passenger elevator, during its ascent the passenger weight is opposing the system and therefore the motor must act to raise the passenger's weight in addition to the weight of the elevator's system itself. When however said elevator descends, the passenger's weight is aiding the performance of the motor, i.e., the motor no longer acts alone to drive the system but rather said force is an added component to the component supplied by the motor in the direction of movement of the elevator. The load on the elevator will therefore directly affect the power requirement of the system.

It should be understood that the term motor driving the system refers both to the case when electrical energy is transferred by the motor to the elevator system and to the case when energy is supplied by the system through the motor, acting as a generator, back to the electric power source.

For various reasons such as safety, preservation of equipment etc. it is sometimes desired to have a conveyance system in which its power requirement is independent of its load and in particular when said load is of a frequently changing nature.

A specific use of load cancelling means in conveyance systems can be made in conveyance systems especially for use on the Sabbath and Holidays, since in accordance with the Jewish Sabbath laws it is prohibited to cause or to perform certain actions on the Sabbath or holydays (hereinafter Sabbath). For instance on the Sabbath it is prohibited to actuate directly or indirectly electrical equipment unless it is done in a special manner which is defined as "grama" (causative) by the Sabbath laws.

The manner in which the passenger weight interacts with the load cancelling means must in itself be permitted under said Sabbath laws. Therefore in addition to said load cancelling system such conveyance apparatus will be equipped with further subsystems adapted to convert all the operations into operations which are considered to be causative and are allowed to be performed on the Sabbath. It is therefore suggested that such systems will work without interruption during the Sabbath, according to an automatic program, stopping at each preselected station or floor while the doors open and close after a preprogrammed given time lapse. Hence, most of the control switches such as Call Switches; Call Location Switches and Open Door and Close-Door Push Buttons will be inoperative, while switches required for the proper operation of the system, such as Change of Direction Switches; Slow-down Switches, Relevelling Switches (if required) Emergency Door-Open Switch could be replaced or preceded by specially designed Sabbath Switches.

In addition to these constantly operated Sabbath Switches, there may exist a special need for diversion from the preprogrammed stay time in each station or floor. For example, in case the automatically operated elevator door is held open intentionally or accidentally by a passenger or in hospitals where a patient confined to a bed has to be transferred to another floor by means of any conveyance system. In such cases a specially installed indirectly operated Sabbath Switch e.g. of the type described in our co-pending application No. 40049, will have to be operated in order to delay the closing of the door as long as required. The resumption of the operation of the automatic door after said delay should be effected by the automatic preprogrammed control so that the reactuation of the system will not be a direct result of the closing of the stalled door, but rather a result of the preprogrammed automatic operation which takes over automatically once again. Furthermore, for emergency cases, the system may be equipped with means such as special keys, whereby it will no longer operate according to its preprogrammed schedule but rather in accordance with the immediate command signal which it receives from a special Sabbath Switch or other switch.

From the above short description of the operation of a Sabbath conveyance means it can be seen that while most functions of a conveyance system could be prearranged to work automatically, or with specially allowable causative switches, thus eliminating the user's direct influence on other system functions which are forbidden according to the Sabbath law, the problem of the weight of the load which directly influences the operation of the motor, has heretofore not been solved.

It is therefore one of the objects of the invention to provide a system whereby the passenger and/or article load is cancelled in a manner which is allowed by said Sabbath law and thus to provide a conveyance system which is permitted for Sabbath use.

The load independence system of the present invention basically consists of the following elements: a weighing device, a braking device, and a control or transmission device, with amplification means, where required. The control or transmission device acts as an interface between the other two devices and translates the results of the weighing operation into appropriate operation of the braking device.

Thus according to the invention there is provided a load cancelling system for conveyance systems especially adapted for cancelling the effect of the load weight, said system comprising at least one weighing device adapted to determine the weight of the load on the conveyance, a braking device adapted to dissipate energy from the conveyance motor and interface means between said devices for translating the result of the weighing operation to a corresponding braking operation.

With specific reference now to the figures in detail it is stressed that the particulars shown are by way of example and for purposes of illustrative discussion of a preferred embodiment of the present invention only and are presented in the cause of providing what is believed to be the most useful and readily understood description of the principles and conceptual aspects of the invention. In this regard no attempt is made to show structural details of the system and its apparatus in more detail than is necessary for a fundamental understanding of the invention, the description taken with the drawings making apparent to those skilled in the art how the several forms of the invention may be embodied in practice.

Figure 1:
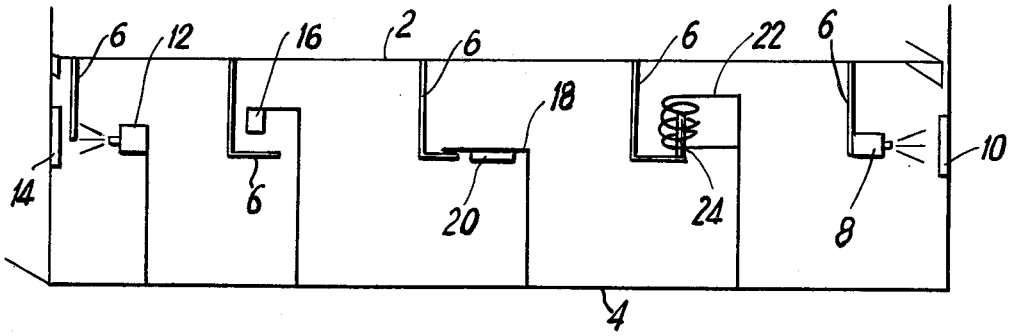
FIG. 1 is a schematic illustration of various embodiments of the weighing devices installed in the conveyance floor.

With reference in general to FIG. 1, the continuous weighing device, which determines the weight of the passenger load in the conveyance, may be actuated by bending, compression or stretching of mechanical elements of the floor or by their displacement relative to other elements. The change of shape, size or position of the mechanical element may be used to actuate other mechanical elements or may be translated into an electrical signal by photoelectric devices 8, 10, 12, 14, strain gauge 20, inductive devices 22, capacitive detector, load cells or proximity detector 16 which cause changes in voltage, current, or frequency as described hereinafter or other similar devices.

One example, among many others shown in FIG. 1, is a floating conveyance car floor 2 supported by a spring or cushion (not shown) on the car frame 4. Weight on the floor 2 causes compression of the cushion and downward displacement of the floor with respect to the car frame 4. The movement of the floor can be used to generate the weight information by means of any of the numerous suggested devices shown attached to the same floor 2 in FIG. 1. The common operational feature of said devices is the arrangement whereby the movement or displacement of the floor operates a mechanical lever or dependent member 6 attached to the underside thereof. The resulting movement or displacement action of said member 6 can be used to operate any of the devices shown in the figure or can operate a completely mechanical system. Hence, the movement of the floor may cause a corresponding movement of a light source 8 attached to the floor. The movement of the light beam which is proportional to the load, may be adjusted for either the addition or the removal of illumination from the surface of a stationary photo-potentiometer 10. For example, the removal of light from part of the surface area of the photo-potentiometer causes an increase in the photo-potentiometer's resistance, linear with increasing load. Increase in load, therefore, will decrease the illuminated area of the photo-element, increase its resistance, and thereby decrease the electrical current flowing therethrough. The current is used to supply the control signal for the braking device. Alternatively, the light source 12 may be fixed to the frame 9 and the movement of the car floor interposes a member 6 between the light and a photopotentiometer 14. Similarly the floor movement could cause rotation of a circular mechanical element (not shown) to which the light source is attached. Rotation of the light beam causes a narrow focused or collimated beam to fall on different parts of the photo potentiometer 14 to cause change in its resistance. Since the CdS photopotentiometer, as other CdS and CdSe devices, is known to be very temperature sensitive and subject to memory of previous exposure to light, it may be desirable, as an alternative to the CdS element, to use a row of parallel connected silicon solar cells operated as current sources in the photovoltaic mode. Removal of light fron some of the cells reduces the current output. Similarly, series connected cells could be used to short circuit resistor elements.

According to another embodiment shown in FIG. 1 the downward movement of the floor 2 due to added load, moves member 16 attached to the frame. Similarly, the moving floor can change the bending moment applied to a metal angle 18 attached to the frame. The change in tension in a strain gauge 20 is the source of the signal. In the example shown the signal producing elements are attached to the non-moving frame while the moving floor bears upon the part of the frame upon which it acts but towhich it is not attached. In the operation of both the load cell and strain gauge, it may be preferred that the load cell be under compression or the strain gauge under tension for an unloaded car condition. Increased load relieves the stress in the detector. For an overload condition of the car, the strain gauge is not allowed to pass through its unstressed point.

As further shown in the figure, the weighing device may consist of a coil 22 attached to the car frame 2 and an iron core 2 attached to the moving floor. Lowering of the floor because of increased load causes partial removal of the core from the coil, thereby increasing the alternating current through the coil which current is used to control the braking system.

Furthermore, the moving elevator floor 2 may operate a lever arm which pushes against a multicontact switch such as the Westinghouse Silverstat switch whose contacts short circuit sections of a resistor. Similarly movement of the lever arm can operate successively a group of changeover-contact microswitches or similar switches. These switches are attached to a ladder net work connecting successive resistor elements to the positive or negative supplies as in a digital to analogue converter. Movement of the floor changes the resistances and thereby changes the voltage output from the ladder. It is sometimes desired that the weight differential between successive switches should be less than 60 kg. Because the voltage output of such a device is a staircase voltage rather than a continuous linear function, the braking steps may be so arranged that at no time will the power requirements be less than those of an empty car at the same stage of its movement.

Figure 2:
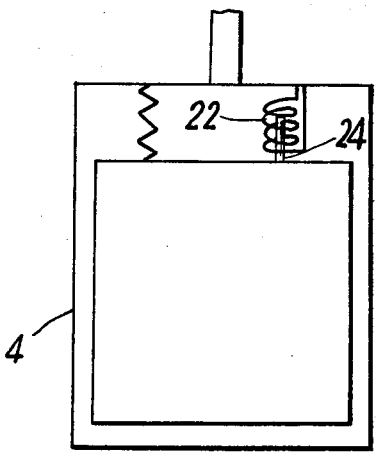
FIG. 2 is a schematic illustration of a weighing device attached to the top of a suspended car.

In some conveyance systems, e.g., in an elevator, the car is suspended from the top of a frame 4 as shown in FIG. 2. In this case the detecting element consisting, for example, of a coil 22 and a core 24 may be attached and operated at the top of the car.

Figure 3:
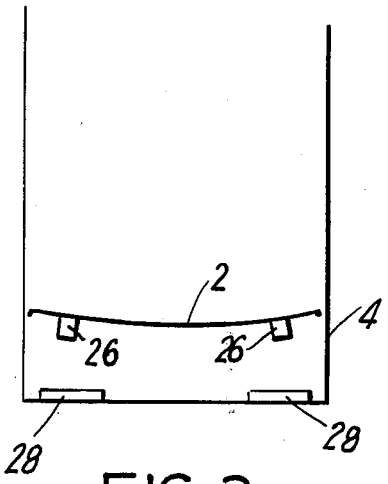
FIG. 3 is a modification of the embodiments of FIG. 1.

In another possible modification shown in FIG. 3, the car floor 2 is designed to have a bending moment. A plurality of light sources 26 are attached to the underside of the floor and photo-potentiometric elements 28 are fixed to the frame 4. As described hereinbefore with reference to FIG. 1, passenger weight on the floor 2 will cause a corresponding bending thereof and a similar corresponding movement of the light from part of the stationary surfaces of the photo-potentiometers 28 to provide a weight dependent signal to the interface means.

Figure 4:
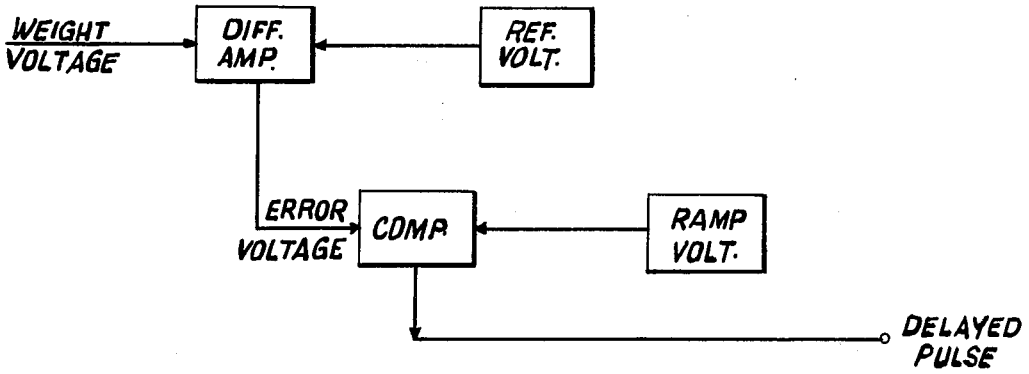
FIG. 4 is an electronic block diagram showing an interface circuit.

The current or voltage output of the weighing device, or plurality of devices, is amplified in an appropriate electronic amplifier to the levels of voltage or current required by the braking device. Either linear or switching amplifiers may be used. To supply appropriate currents to an eddy-current brake or d-c generator field for example, it would be of advantage to use thyristors operating from the a-c power mains with delayed phase-angle firing. As shown in FIG. 4 the control voltage from the weighing device would be compared with a reference voltage in a differential amplifier. The resulting voltage would than be compared, in a voltage comparator or Schmitt trigger, with a ramp voltage synchronized with the a-c power lines. The ramp voltage may be obtained from a Miller integrator, bootstrap, digital staircase generator, or phase-shifted a-c line voltage and may be gated, where necessary, by gates obtained from the a-c line.

Various types of braking devices are adaptable to the system: for applying a braking action corresponding to the signal derived from the car weight, such as a Foucault brake, a D.C. generator, a mechanical brake etc. In the Foucault brake, eddy currents are generated in the rotor by the action of current flowing in the stator coil. The Foucault brake is attached to the shaft of the motor and rotates with it. When current is introduced in the stator, braking action results. When a D.C. generator is used, said generator is mounted on the shaft of the motor and generates a voltage. The voltage generated is a function of the generator field current. The generator output is connected to a fixed resistive load capable of dissipating almost double the power of the motor. When current is introduced into the field windings of the generator the armature will dissipate energy in the load connected to it in accordance with the value of the field excitation.

In a mechanical brake for example, brake-shoes pressing against a drum or disk mounted on the hoist motor shaft can provide mechanical braking action.

The braking action is a linear function of the passenger load. In descent it is a positive function with maximum braking corresponding to maximum load. In ascent the function has a negative slope with maximum braking at no load and zero braking at maximum load.

The braking force in descent which results from the load weight is exactly equal to the weight force and is applied in the opposite direction. The resultant force is therefore zero. Under this condition the motor senses no load and its power requirement is the same as that for an empty car. In ascent the braking force is equal to maximum load when the car is empty acting in the same direction as the load and therefore replacing it under this condition. For any load, the sum of the load and the braking force acting in the same direction is constant and equal to the full load. The motor senses a full load under all conditions and the power requirements are therefore constant.

As an example of another means of braking by removing energy from the rotating system, a pump can be attached to the rotating motor shaft. A variable amount of liquid is supplied to the pump from a control valve and the amount of liquid from the valve is controlled by the weighing devices. The raising of the liquid to a given height dissipates energy from the rotating motor shaft. Similarly any hydraulic, pneumatic, friction, electrical or other means to dissipate energy may be used.

It will be evident to those skilled in the art that the invention is not limited to the details of the foregoing illustrative embodiments and that the present invention may be embodied in other specific forms without departing from the spirit or essential attributes thereof, and it is therefore desired that the present embodiments be considered in all respects as illustrative and not restrictive, reference being made to the appended claims, rather than to the foregoing description, in which it is intended to claim all modifications coming within the scope and spirit of the invention.

We claim:

1. A load-cancelling system, for conveyance systems having a power source, driving means and braking means, said load cancelling system being adapted to cancel the effect of a load weight on the requirements from the power source and comprising at least one weighing device adapted to determine the weight of the load on the conveyance, a supplementary braking device adapted to dissipate energy supplied to the system by the load and interface means between said devices for translating the result of the weighing operation to a corresponding braking operation.

2. The system as claimed in claim 1 wherein said weighing device is adapted to continuously determine the load in the conveyance.

3. The system as claimed in claim 1 wherein said weighing device is adapted to provide an electrical signal corresponding to the displacement of a floating arrangement relative to a fixed frame.

4. The system as claimed in claim 1 wherein the conveyance is provided with a floor having a bending moment and wherein at least one part of a weighing device is attached to said floor.

5. The system as claimed in claim 1 wherein said weighing device is attached to a conveyance body suspended from a frame and adapted to provide a signal corresponding to the load weight.

6. The system as claimed in claim 1 wherein the arrangement is such that said weighing device is adapted to provide maximum signal for an unloaded conveyance and a signal of a decreasing magnitude for a corresponding increase in the conveyance weight load, or vice-versa.

7. The system as claimed in claim 1 wherein said weighing device is means placed under tension or stress for an unloaded conveyance and adapted to release said tension or stress with increase in load, or vice-versa.

8. The system as claimed in claim 5 wherein said device is an inductive means having a displaceable core member, said core member being inserted in said inductive means when said conveyance is in an unloaded state and removed therefrom by the load, or vice-versa.

9. The system as claimed in claim 1 wherein the braking operation follows a linear function of the load weight.

10. A load cancelling system, for conveyance systems having a power source, driving means and braking means, said load cancelling system being adapted to cancel the effect of a load weight on the requirements from the power source, and comprising at least one weighing device adapted to determine the weight of the load on the conveyance, a supplementary braking device adapted to dissipate energy supplied to the system by the load when the load adds energy to the system and dissipate energy equivalent to the difference between full load and the existing load when the load requires energy from the driving system.

* * * * *